US007471273B2

(12) United States Patent
Hewlett et al.

(10) Patent No.: US 7,471,273 B2
(45) Date of Patent: Dec. 30, 2008

(54) BIT SEGMENT TIMING ORGANIZATION PROVIDING FLEXIBLE BIT SEGMENT LENGTHS

(75) Inventors: Gregory J. Hewlett, Richardson, TX (US); Harold E. Bellis, II, Garland, TX (US)

(73) Assignee: Texas Instruments Incorporated, Dallas, TX (US)

( * ) Notice: Subject to any disclaimer, the term of this patent is extended or adjusted under 35 U.S.C. 154(b) by 684 days.

(21) Appl. No.: 11/031,186

(22) Filed: Jan. 7, 2005

(65) Prior Publication Data

US 2005/0184938 A1 Aug. 25, 2005

Related U.S. Application Data

(60) Provisional application No. 60/535,132, filed on Jan. 7, 2004.

(51) Int. Cl.
*G09G 3/36* (2006.01)

(52) U.S. Cl. ..... 345/87; 345/48; 345/84; 345/85; 345/108

(58) Field of Classification Search ..... 345/87, 345/84–85, 48, 108
See application file for complete search history.

(56) References Cited

U.S. PATENT DOCUMENTS 5,764,208 A * 6/1998 Burton et al. ..... 345/85
6,008,785 A * 12/1999 Hewlett et al. ..... 345/85
6,573,951 B1 * 6/2003 Hewlett et al. ..... 348/770

* cited by examiner

*Primary Examiner*—Richard Hjerpe
*Assistant Examiner*—Leonid Shapiro
(74) *Attorney, Agent, or Firm*—Wade J. Brady, III; Frederick J. Telecky, Jr.

(57) ABSTRACT

Disclosed are reset techniques for a spatial light modulator, and related system for displaying an image. The systems and methods have pixels that are loaded with data and reset commands to take on binary states, where the methods employ adaptable algorithms to provide flexibility in placement of the reset commands. Specifically, valid regions for such reset commands are determined, and times for consecutive bit segments are calculated; and DMD load times are adjusted for a proper sequence. An advantage of the disclosed methods is that two consecutive bit segments are no longer restricted to following a pattern of normal/short bit segments. In contrast, with the disclosed technique short segments may be consecutive, allowing the implementation of additional enhancements, including neutral density filtering (NDF) techniques that typically include adjacent short bits in the bit sequence.

20 Claims, 6 Drawing Sheets

BIT SEGMENT TIMING ORGANIZATION PROVIDING FLEXIBLE BIT SEGMENT LENGTHS

CROSS-REFERENCE TO RELATED APPLICATIONS

This application claims priority to U.S. Provisional Patent Application No. 60/535,132 filed Jan. 7, 2004, entitled "Bit Segment Timing Organization Providing Flexible Bit Seginent Lengths," which is hereby incorporated by reference for all purposes.

TECHNICAL FIELD

Disclosed embodiments herein relate generally to the field of image display systems using Special Light Modulators (SLMs), and more particularly to methods for providing flexible load/reset sequences for such display systems.

BACKGROUND

Spatial light modulators are in wide use in displays systems and are increasingly being used due to having the benefit of high resolution while consuming lower power and less bulk than conventional Cathode Ray Tube (CRT) technology. One type of SLM display is the Digital Micro-Mirror Device (DMD). The DMD device typically consists of an array of small reflective surfaces, mirrors, on a semiconductor wafer to which electrical signals are applied to deflect the mirrors and change direction of the reflected light applied to the device. A DMD-based display system is created by projecting a beam of light to the device, selectively altering the individual micro-mirrors with image data, and directly viewing or projecting the selected reflected portions to an image plane, such as a display screen. Each individual micro-mirror is individually addressable by an electronic signal and makes up one "display element" of the image. These micro-mirrors are often referred to as picture elements or "pixels", which may or may not correlate directly to the pixels of an image. This use of terminology is typically clear from context, so long as it is understood that more than one pixel of the SLM array may be used to generate a pixel of the displayed image.

Generally, projecting an image from an array of DMD pixels is accomplished by loading memory cells connected to the pixels. Once each memory cell is loaded, the corresponding pixels are reset so that each one tilts in accordance with the ON or OFF state of the data in the memory cell. For example, to produce a bright spot in the projected image, the state of the pixel may be ON, such that the light from that pixel is directed out of the SLM and into a projection lens. Conversely, to produce a dark spot in the projected image, the state of the pixel may be OFF, such that the light is directed away from the projection lens.

Modulating the beam of light with a micro-mirror is used to vary the intensity of the reflected light, such as through Pulse Width Modulation (PWM). Although the micro-mirrors can be moved relative to the bias voltage applied, the typical operation is a digital bi-stable mode in which the mirrors are fully deflected at any one time. Generating short pulses and varying the duration of the pulse to an image bit changes the time in which the portion of the image bit is reflected to the image plane versus the time the image bit is reflected away, therefore distributing the correct amount of light to the image plane.

The above-described pulse-width modulation techniques may be used to achieve varying levels of illumination in both black/white and color systems.

For generating color images with SLMs, one approach is to use three DMDs: one for each primary color of red, green, and blue (RGB). The light from corresponding pixels of each DMD is converged so that the viewer perceives the desired color. Another approach is to use a single DMD and a color wheel having sections of primary colors. Data for different colors is sequenced and synchronized to the color wheel so that the eye integrates sequential images into a continuous color image. Another approach uses two DMDs, with one switching between two colors and the other displaying a third color.

A PWM scheme is determined by using the display rate at which images are presented to the viewer and the number of intensity levels available by the display system. The display system rate gives the time that the image frame is available for viewing. For example, a standard television signal is transmitted at 30 frames per second (fps), which is a frame time of 33.3 milliseconds. For a system having n bits of resolution, the image has $2^n$ levels of intensity. Thus, if the system has 4 bits of intensity resolution, there could be 16 levels of intensity. To create the perception of an intensity level, in PWM systems, the frame is divided into equal time slices, which will display a quantized intensity. For a system having n bits of intensity resolution, the frame is divided into $2^{n-1}$ equal time slices. After the image element intensity is quantized, a black value, 0, would contain no intensity and be equivalent to 0 time slices while the maximum brightness level would have the display element on for all of the time slices, or $2^{n-1}$ time slices.

An established method to get the time slices into a display frame is to format the data into "bit planes" where each bit-plane corresponds to a bit weight of the intensity value. A system with the 4 bits of intensity resolution would have 4 bit-planes and each bit-plane would be weighted with appropriate time slices. An example would be that the $2^1$ bit or least significant bit (LSB) would have one time slice, the $2^2$ bit would have two time slices, the $2^3$ bit would have 4 time slices, and the $2^4$ bit or MSB would have $2^n/2$ or 8 time slices. By displaying all of the bit-planes within a frame, any of the capable intensity levels can be created in this weighted method. Bit-planes may be displayed in various orders. The bit-plane that only represents one time has the shortest "on" time for the display elements, and the time to load this LSB bit-plane is the "peak data rate." Since SLM display systems typically have many display elements and since the desired intensity levels are higher than the example above, the data rates to get the intensity information to each display element can become very high.

U.S. Pat. No. 5,278,652, entitled "DMD Architecture and Timing for Use in a Pulse-Width Modulated Display System," assigned to Texas Instruments Inc., describes various methods of addressing a DMD in a DMD-based display system. These methods are directed to reducing the peak data rate while maintaining optical efficiency. Some of the methods discussed therein include clearing blocks of pixel elements and using extra "off" times to load data. In one method the time in which the most significant bit is displayed is broken into smaller segments so as to permit loading for less significant bits to occur during these segments.

Another method of reducing the peak data rate is referred to as "memory multiplexing" or "split reset." This method uses a specially configured SLM, whose pixels are grouped into reset groups that are separately loaded and addressed. Although this increases the complexity of the device, the method reduces the amount of data to be loaded during any one time and permits the LSB data for each reset group to be loaded at a different time during the frame period. This configuration is described in U.S. patent application Ser. No. 08/002,627, which is commonly assigned to Texas Instruments Inc. with the present disclosure.

PWM methods can result in the display of visual artifacts that the viewer can perceive. Regardless of whether or not the pixels of the SLM are addressed all at once or are multiplexed, visual artifacts should be minimized. "Temporal contouring" is a type of artifact possible with bit-plane data when a number of "ON" states occur closely with a number of "OFF" states. As an example, for an 8-bit system, if in one frame a pixel has an intensity level of 128 and the most significant bit (MSB) display time occurs during the first half of the frame time, the pixel is ON for this length of time and OFF for the rest of the frame time. If, in the next frame, the pixel's intensity is 127, the pixel is OFF for the MSB time and ON during the display time for all other bits during that frame. The point in time when all bits change state can cause a visual artifact, which is more perceptible as brightness increases. Thus, artifacts such as these temporal artifacts are undesirable and should be removed from the final displayed image.

BRIEF SUMMARY

Disclosed are reset techniques for a spatial light modulator that have pixels that are loaded with data and reset commands to take on binary states, where the methods employ adaptable algorithms to provide flexibility in placement of the reset commands. Specifically, valid regions for such reset commands are determined, and times for consecutive bit segments are calculated; and DMD load times are adjusted for a proper sequence.

An advantage of the disclosed methods is that two consecutive bit segments are no longer restricted to following a pattern of normal/short bit segments. As used herein, the term "short bit" is a bit having a length that is less than the overall full load time for all of the groups loaded for a single frame of an image (as distinguished from a DMD load time, which is the time required to load pixel data into the DMD/SLM for a single bit-plane/group). Conversely, a "normal bit" is a bit having a length longer than the full load time for all of the groups. In conventional methods and algorithms, bit segments that were classified as "short" could typically not be consecutive, since each would need to be adjacent a "normal" bit to compensate for the shorter segment length. In the disclosed technique, however, short segments may be consecutive, allowing the implementation of additional enhancements, including neutral density filtering (NDF) techniques that typically include adjacent short bits in the bit sequence.

In one aspect, what is provided is a method for displaying an image on a display system employing a spatial light modulator having pixels addressable with orienting and reorienting data formatted in corresponding bit-planes, where each of the bit-planes are loaded as segments in a bit sequence during a frame-time. In such an embodiment, the method includes providing a first load signal to the spatial light modulator, where the first load signal has orienting data for at least one of the pixels, as well as providing a first reset signal to the spatial light modulator for orienting the at least one pixel in accordance with the orienting data. In addition, the method includes providing a second load signal to the spatial light modulator, where the second load signal has reorienting data for the at least one pixel, and providing a second reset signal to the spatial light modulator for reorienting the at least one pixel in accordance with the reorienting data, where an amount of time between providing the first and second reset signals defines a length of time of a first segment of the at least one pixel.

Still further, this embodiment of the method includes providing a third load signal to the spatial light modulator, where the third load signal has further reorienting data for the at least one pixel, and providing a third reset signal to the spatial light modulator for further reorienting the at least one pixel in accordance with the further reorienting data, where an amount of time between providing the second and third reset signals defines a length of time of a second segment of the at least one pixel after the first segment. Furthermore, the method in such an embodiment provides for adjusting times for providing the first, second, and third reset signals after their corresponding first, second, and third load signals such that the first and second segments are each less than or each greater than a full load-time for the spatial light modulator. In another aspect, systems for displaying an image are also provided, where the systems also include a spatial light modulator having addressable pixels configured to reflect a portion of the image based on orienting and reorienting data, similar to the exemplary method set forth above.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF PREFERRED EMBODIMENTS

A comprehensive description of a DMD-based digital display system is set out in U.S. Pat. No. 5,079,544, entitled "Standard Independent Digitized Video System," and in U.S. patent application Ser. No. 08/147,249, entitled "Digital Television System," and in U.S. patent application Ser. No. 08/146,385, entitled "DMD Display System." Each of these patents and patent applications is assigned to Texas Instruments Inc., and each is incorporated by reference herein. An overview of such systems is discussed below in connection with FIG. 1.

Figure 1:
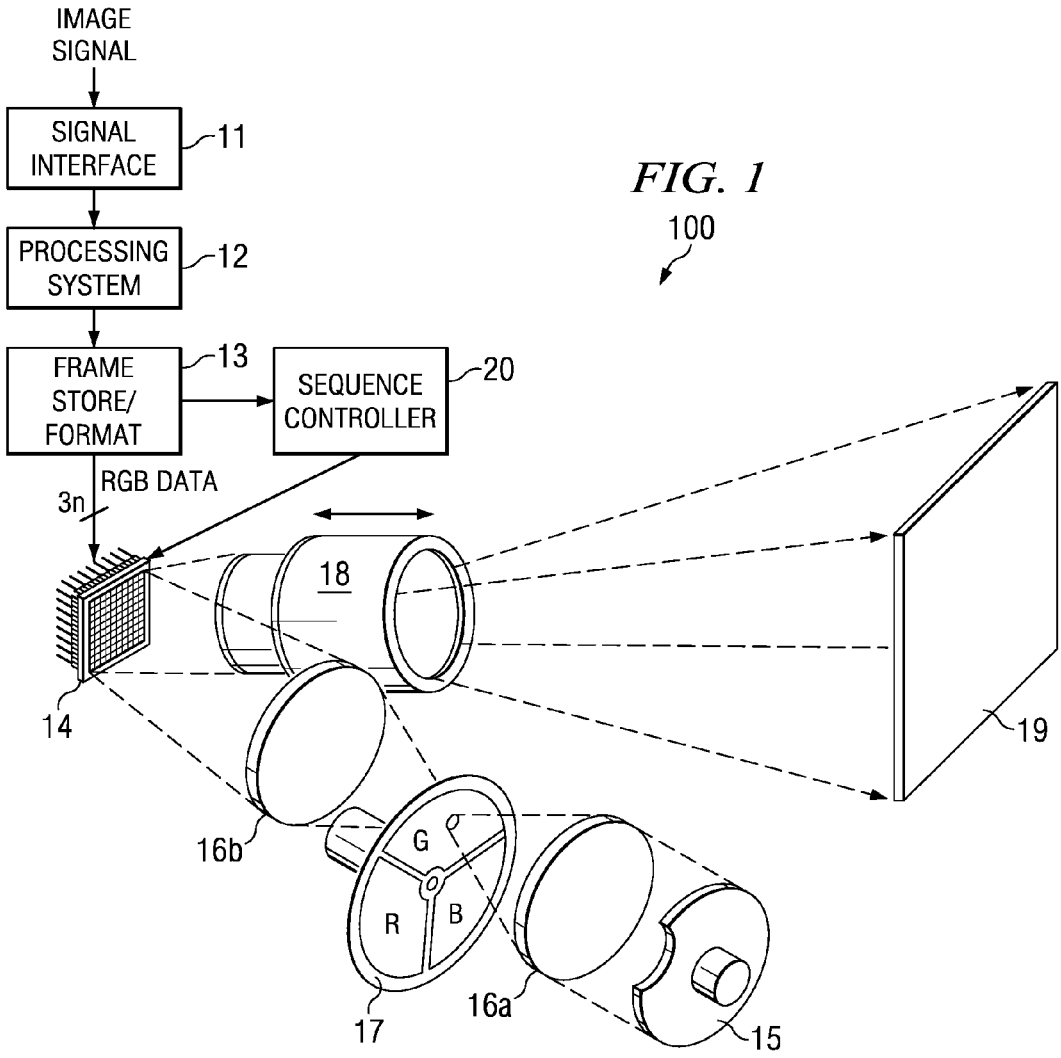
FIG. 1 illustrates one embodiment of a projection visual display system, which uses an SLM having a DMD therein to generate real-time images from an input signal.

Referring initially to FIG. 1, illustrated is one embodiment of a projection visual display system 100, which uses a DMD 14 to generate real-time images from an input signal. The input image signal may be from a television tuner, MPEG decoder, video disc player, video cassette player, PC graphics card, or the like. Only those components significant to main-screen pixel data processing are shown. Other components, such as might be used for processing synchronization and audio signals or secondary screen features, such as closed captioning, are not shown for simplicity.

In the illustrated embodiment, an input image signal, which may be an analog or digital signal, is input to a signal interface unit 11. In embodiments where the input signal is analog, an analog-to-digital converter (not illustrated) may be employed to convert the incoming signal to a digital data signal. Signal interface unit 11 receives the data signal and separates video, synchronization, and audio signals. In addition, a Y/C separator is also typically employed, which converts the incoming data from the image signal into pixel-data samples, and which separates the luminance ("Y") data from the chrominance ("C") data, respectively. Alternatively, in other embodiments, Y/C separation could be performed before A/D conversion.

The separated signals are then input to a processing system 12. Processing system 12 prepares the data for display, by performing various pixel data processing tasks. Processing system 12 may include whatever processing components and memory useful for such tasks, such as field and line buffers. The tasks performed by the processing system 12 may include linearization (to compensate for gamma correction), colorspace conversion, and interlace to progressive scan conversion. The order in which any or all of the tasks performed by the processing system 12 may vary.

Once the processing system 12 is finished with the data, a display memory module 13 receives processed pixel data from the processing system 12. The display memory module 13 formats the data, on input or on output, into bit-plane format, and delivers the bit-planes to the SLM. As discussed in the Background section, the bit-plane format permits single or multiple pixels on the DMD 14 to be turned on or off in response to the value of one bit of data, in order to generate one layer of the final display image. In one embodiment, the display memory module 13 is a "double buffer" memory, which means that it has a capacity for at least two display frames. In such a module, the buffer for one display frame may be read out to the SLM while the buffer for another display frame is being written. To this end, the two buffers are typically controlled in a "ping-pong" manner so that data is continuously available to the SLM.

For the next step in generating the final desired image, the bit-plane data from the display memory module 13 is delivered to the SLM. Although this description is in terms of an SLM having being a DMD 14 (as illustrated), other types of SLMs could be substituted into display system 100. Details of a suitable SLM are set out in U.S. Pat. No. 4,956,619, entitled "Spatial Light Modulator," which is commonly owned with the present disclosure and is incorporated herein by reference in its entirety. In the case of the illustrated DMD-type SLM, each piece of the final image is generated by one or more pixels of the DMD 14, as described above. The SLM uses the data from the display memory module 13 to address each pixel on the DMD 14. The "ON" or "OFF" state of each pixel forms a black or white piece of the final image, and an array of pixels on the DMD 14 is used to generate an entire image frame. Each pixel displays data from each bit-plane for a duration proportional to each bit's PWM weighting, which is proportional to the length of time each pixel is ON, and thus to each pixel's intensity in displaying the image. In the illustrated embodiment, each pixel of the DMD 14 has an associated memory cell to store its instruction bit from a particular bit-plane.

For each frame of the image to be displayed in color, Red, Green, Blue (RGB) data may be provided to the DMD 14 one color at a time, such that each frame of data is divided into red, blue, and green data segments. Typically, the display time for each segment is synchronized to an optical filter, such as a color wheel 17, which rotates so that the DMD 14 displays the data for each color through the color wheel 17 at the proper time. Thus, the data channels for each color are time-multiplexed so that each frame has sequential data for the different colors. Moreover, in systems employing neutral-density (ND) color filtering, the color wheel 17 may include additional sections for illuminating ND versions (i.e., decreased intensity) of the basic RGB colors. A detailed description of ND filtered illumination using a color wheel may be found in U.S. Pat. No. 5,812,303, which is commonly owned with the present disclosure and incorporated herein by reference in its entirety.

For a sequential color system, such as the system 100 illustrated in FIG. 1, a light source 15 provides white light through a condenser lens 16*a*, which focuses the light to a point on the rotating color wheel 17. A second lens 16*b* may be employed to fit the colored light output from the color wheel 17 to the size of the pixel array on the DMD 14. Reflected light from the DMD 14 is then transmitted to a display lens 18. The display lens 18 typically includes optical components for illuminating an image plane, such as a display screen 19.

In an alternative embodiment, the bit-planes for different colors could be concurrently displayed using multiple SLMs, one for each color component. The multiple color displays may then be combined to create the final display image. Of course, a system or method employing the principles disclosed herein is not limited to either embodiment.

Also illustrated in FIG. 1 is a sequence controller 20 associated with the display memory module 13 and the DMD 14. The sequence controller 20 provides reset control signals to the DMD 14, as well as load control signals to the display memory module 13. These signals are typically ordered in a sequence generated in accordance with the principles disclosed below. An example of a suitable sequence controller is described in U.S. Pat. No. 6,115,083, entitled "Load/Reset Sequence Controller for Spatial Light Modulator", which is commonly owned with the present disclosure and incorporated herein by reference in its entirety.

Figure 2:
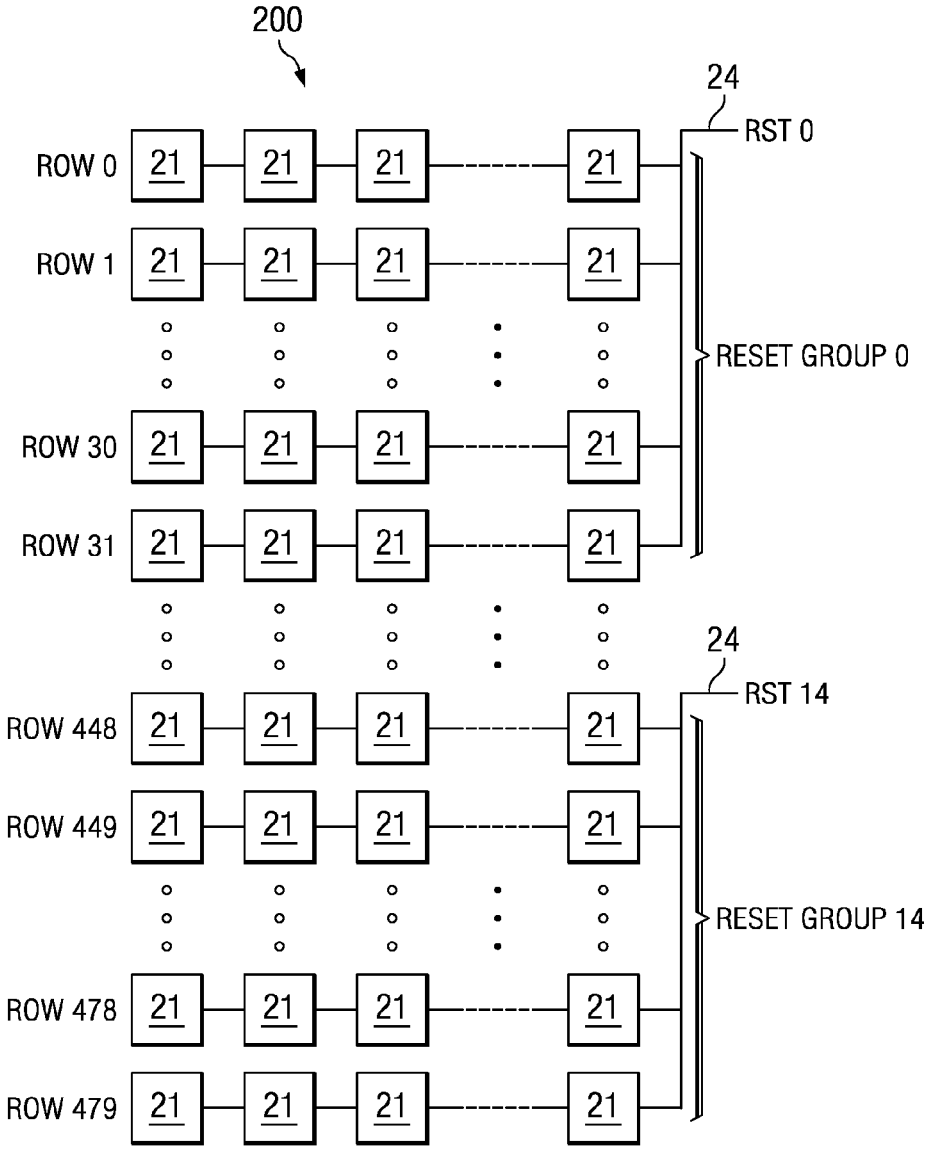
FIG. 2 (PRIOR ART)
FIG. 2 illustrates a portion of the array of micro-mirrors found on DMD in FIG. 1.

Turning now to FIG. 2, illustrated is a portion of the array 200 of micro-mirrors (i.e., "pixels") 21 found on DMD 14 in FIG. 1. In the illustrated embodiment, the array 200 is configured for divided or "phased" reset addressing. As explained below, addressing the pixels 21 typically requires that each pixel's 21 memory cell be loaded with data derived from bit-sequences for each bit-plane of the desired image, and that each pixel 21 be reset between loads to operate the pixels 21 in accordance with that data. When operated, the pixels 21 display the data by being ON or OFF for a display time that corresponds to the intensity of light that each pixel 21 generates.

Although only a small number of pixels 21 are illustrated in FIG. 2, the DMD 14 typically has additional rows and columns of pixels 21, as illustrated by the ellipses. The mirror array 200 of a typical DMD 14 has hundreds or even thousands of display pixels 21, each usually with its own memory cell. As shown, the array 200 may be divided into "reset groups" of pixels 21, which are defined by which pixels 21 are connected to a single reset line 24. In the example of FIG. 2, each thirty-two consecutive rows of pixels 21 are connected to a single reset line 24, and are thus a separate group. For example, if a 480-row DMD 14 has thirty-two rows per group, as illustrated, then there are fifteen groups of pixels 21. The bit-plane data for each of the groups is formatted into group data. Thus, where p is the number of active pixels 21 on the DMD 14 and q is the number of groups, a bit-plane having p number of bits is formatted into q groups of data. Therefore, each group of pixels 21 has p/q bits of data.

In many embodiments, the number of groups into which a mirror array 200 is arranged is somewhat arbitrary. In general, the minimum bit-plane display time is inversely proportional to the number of groups. On one hand, shorter bit-times are often desirable because they allow better flexibility for mitigating visual artifacts. However, on the other hand, overall complexity of the display system increases with more groups because of the need for additional drive circuits, package pins, and control circuitry. In general, however, the principles described herein apply to a DMD 14 having any number of groups. Moreover, the rows in each group need not be consecutive, and any pattern is possible, such as an interleaved pattern of every $n^{th}$ row for n number of reset lines. Furthermore, the pattern could be in vertical or diagonal rows, and the pattern need not be row-by-row, but rather in blocks, contiguous or interleaved.

Figure 3:
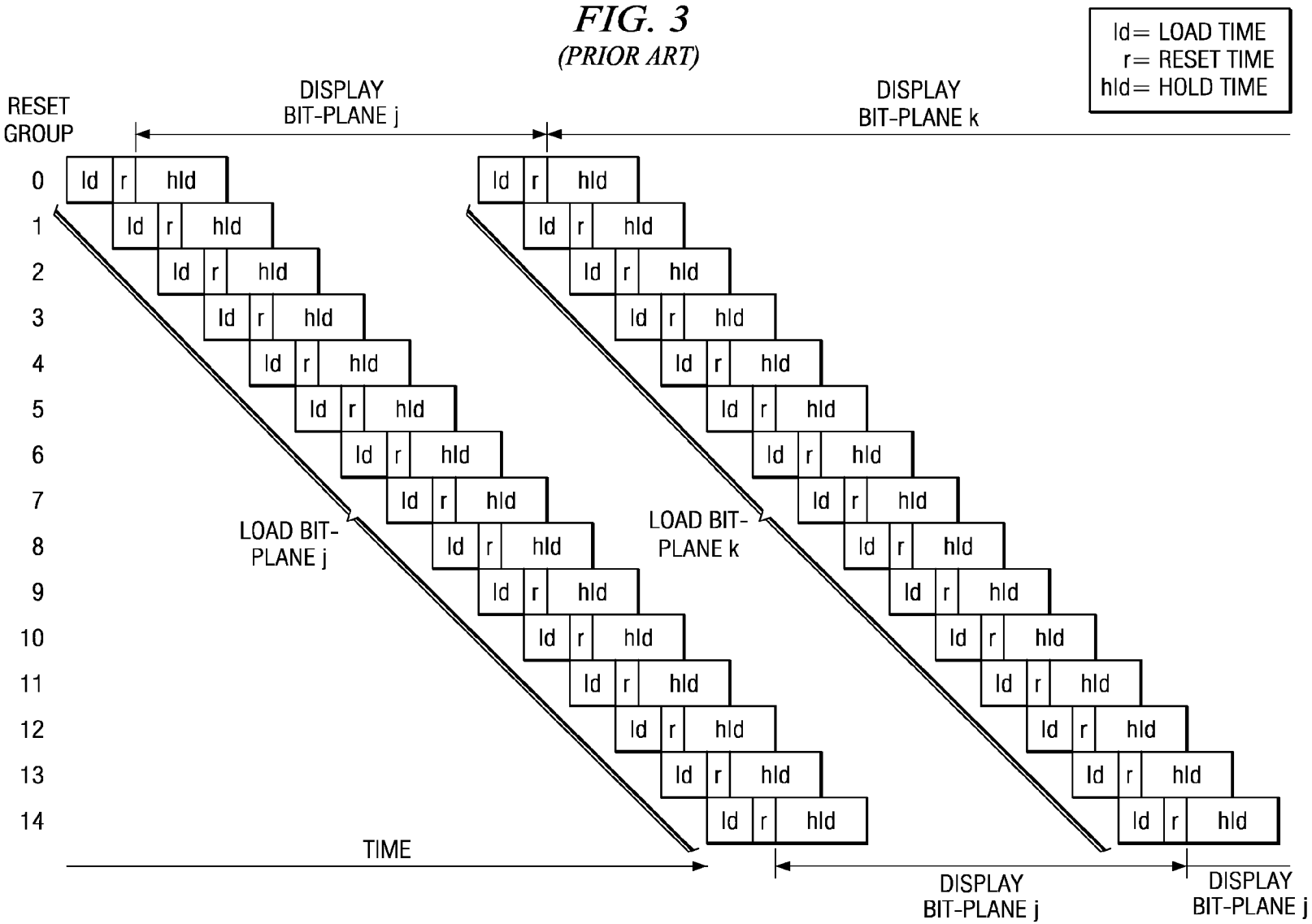
FIG. 3 (PRIOR ART)
FIG. 3 illustrates an example of phased resetting using the fifteen groups of pixels shown in FIG. 2.

Looking now at FIG. 3, illustrated is an example of phased resetting using the fifteen groups of pixels 21 shown in FIG. 2. More specifically, the fifteen groups of pixels 21 are loaded and reset for displaying of a bit-plane "j". Each group is first loaded with data, during a load-time (ld). Then, the pixels 21 for each loaded group are reset. The reset time (r) represents the time when a reset signal is applied on the reset line connected to each particular group. The reset signal causes each pixel 21 in the group to change state in accordance with the data stored in its memory cell. After being reset, the group begins its display time, where at the beginning of the display time, the pixels 21 undergo a hold-time (hld) during which the data should be kept stable.

As soon as one group is loaded, loading of the next group may begin. Such loading, resetting, and displaying process is repeated for each of the fifteen groups, such that after each group is loaded, the loading of the next group begins while the previous group is being reset and displayed. In the embodiment in FIG. 3, the load and reset for each group occurs consecutively, resulting in a phased reset, as distinguished from a "global" reset where all of the groups are reset concurrently once each has been loaded. By employed a phased reset, the display times of the groups for the bit-plane are skewed at the beginning and end of the display time. However, the viewer perceives each pixel's ON-time as if all pixels were on simultaneously for the bit-time.

In this embodiment, the reset of each group occurs immediately after the loading of that group. As a result, the display time is as long as the total time to load all groups typically referred to a "nominal" display time. In the particular example of FIG. 3, the display time for bit-plane j is the same as the time to load all 15 groups, e.g., from the reset of Group 0 to the reset of Group 14. Of course, a nominal display time is not required and the time between load and reset may be delayed for each reset group, which provides shorter display times. Alternatively, loading may be non-continuous, which provides longer display times. Also, the time between load and reset need not be the same among reset groups, which makes it possible to align the resets rather than skew them at the beginning of a bit-plane display time.

Figure 3A:
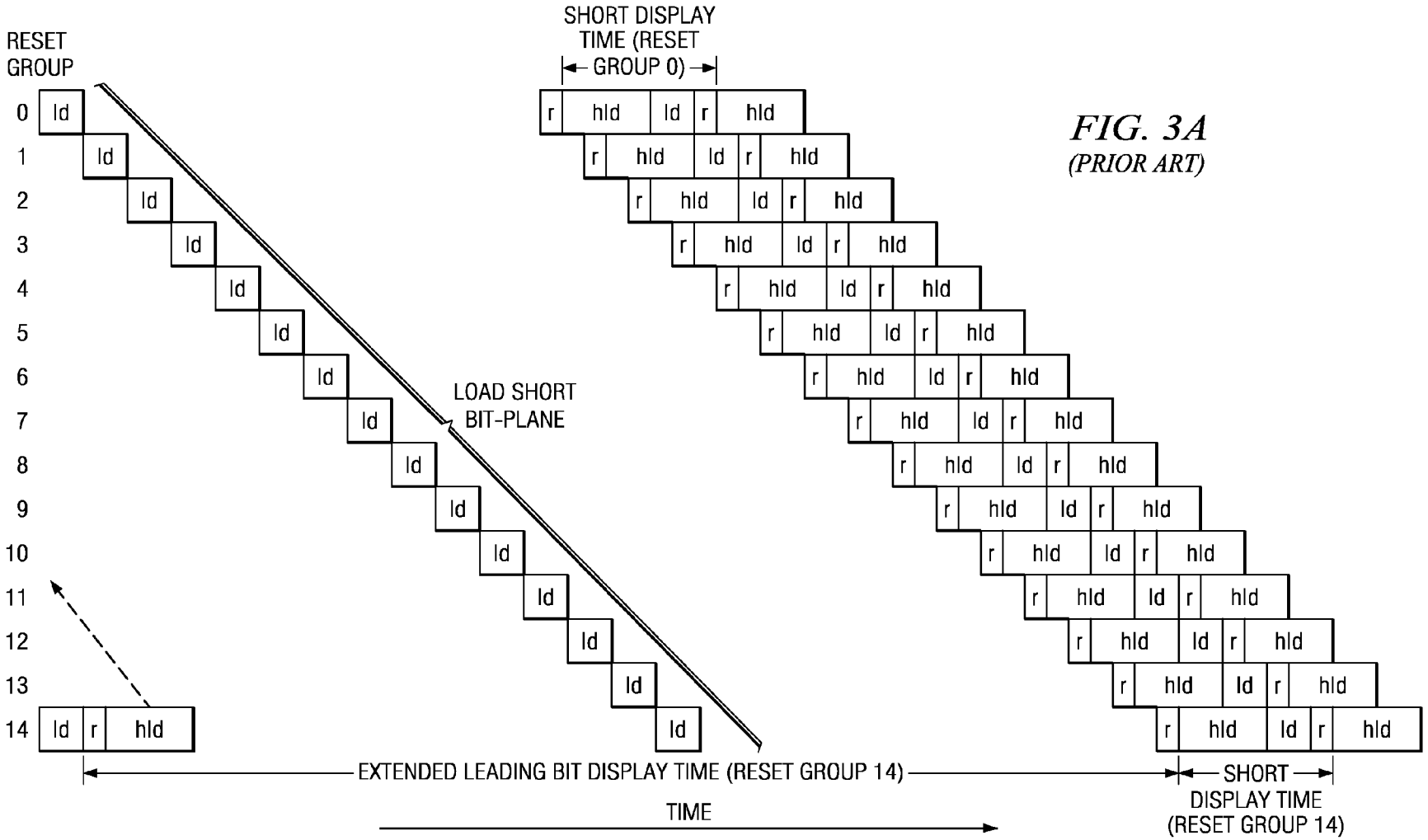
FIG. 3A (PRIOR ART)

Turning briefly to FIG. 3A, illustrated is another example of phased resetting using the fifteen groups shown in FIG. 2, where display times shorter than the nominal display time are accomplished. Specifically, for shorter display times, the resets may be delayed with respect to the loading of bit-sequence data. Additionally, the time between load and reset need not be the same for each of the groups. As a result, it is possible to align the resets, rather than skew them at the beginning of a bit-plane display time, as mentioned above. Examples of various phased reset addressing, including those embodiments discussed above, are discussed in U.S. Pat. No. 6,201,521, which is commonly owned with the present disclosure and incorporated herein by reference in its entirety.

In the example above, an extended bit display time can be used to obtain a short display time, which can reduce visual artifacts. When using this option, a long and a short display sequence are paired together so as to maintain the bit-plane timing. The display time can become as short as the time between two consecutive resets. During a normal load and reset, a display group progresses through a sequence in which the display data is presented to the pixels through the memory location, which in conjunction with load and reset signals, sets the pixels into a state to reflect light to or away from the display plane, corresponding to an "ON" state or a "OFF" state, respectively.

The reset sequence and the load sequence are coordinated with each other so that loads and resets occur at the proper times. In the above examples of reset and load sequences, the delays are from a common reference. The sequence programmed into the sequence controller 18 is the result of a sequence generation process discussed in several of the references cited above. A computer that is programmed in accordance with the principles disclosed herein typically performs such a sequence generation process. A computer so programmed may be referred to herein as a "sequence generator", and may be a general purpose or a dedicated computer.

Figure 4:
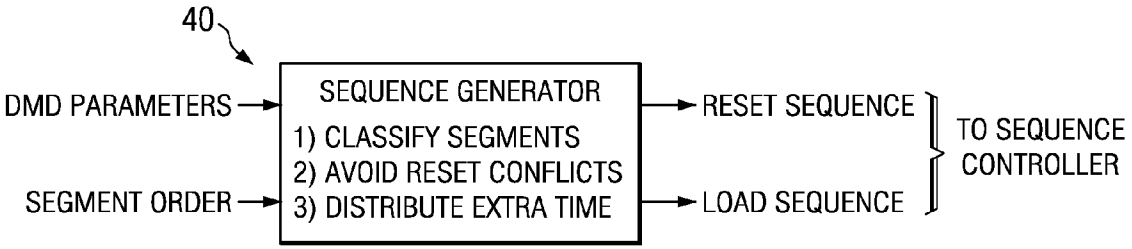
FIG. 4 illustrates a sequence generator that may be employed to generate bit sequences with flexible placements of reset signals in accordance with the principles disclosed herein.

Referring now to FIG. 4, illustrated is a sequence generator 400 that may be employed to generate loads and resets in accordance with the principles disclosed herein. Specifically, the sequence generator 400 generates a sequence of resets and loads and their relative timing, and particularly generates sequences having the reset signals located in selected desirable positions, as described in greater detail below. To generate valid loads and resets, the sequence generator 400 takes into consideration certain incoming data, as well as classifying segments, preventing reset signals of different groups from overlapping (i.e., "reset conflicts"), and distributing "extra time" of certain segments.

Among the data input to the sequence generator 400, "DMD parameters" represent various constraints and dynamics of the DMD 14 that affect resets and loads. Such DMD parameters determine the classification of the segment to be reset or loaded. In addition, the order of segments is also input to the sequence generator 400. The "segment order" is the order in which segments are loaded (and therefore displayed) during a frame-time. A bit-plane having multiple segments is typically loaded multiple times. As such, each bit-plane as data for the series of groups may be delivered, for example, as a segment of the MSB, then a segment of the MSB-2, then the segment for the LSB, then another segment of the MSB, etc, until all segments for all bit-planes are loaded. Table 1 illustrates various DMD parameters that may be used by a sequence generator 400. Such parameters are typically employed in a visual display system having a color wheel that has more than one section per color. In such embodiments, each color has a frame-time (or frame period) that is a portion of the total time for one revolution of the color wheel. Moreover, each color has a sequence for each of its color wheel sections.

TABLE 1

| PARAMETER | DESCRIPTION |
|---|---|
| reset time | time for a normal reset sequence |
| reset | time for a reset sequence |
| release time | time without associated bias on |
| bias on-time | time to activate the bias |
| data hold-time | time after initiation of bias ON after which a load is allowed |
| reset release hold-time | time between reset release and bias ON |
| mirror transit-time | time used to allow for transition of a mirror |
| data setup-time | required time after a load completes after which a reset may be initiated |
| clear time | required time to globally clear device |
| group load-time | time required to load a group |
| minimum r to r time | minimum time between two reset operations |
| frame-time | total time to be taken by all bit-planes of the sequence |
| used frame-time | total time that light will be perceived during a frame |
| number of reset groups | number of groups into which the DMD array is divided |
| color wheel sections | number of colors on the color wheel |
| section-time | time to be taken by each color wheel section |

Figure 5:
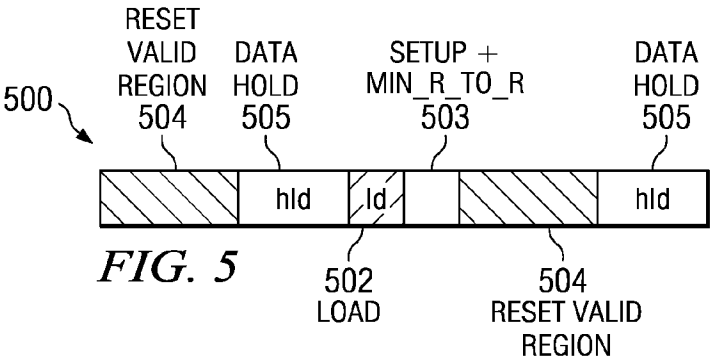
FIG. 5 illustrates a portion of a bit sequence having possible timing constraints associated with bit-plane loading.

Turning now to FIG. 5, illustrated is a portion of a bit sequence 500 in which a given group of display memory may be loaded and reset, in the manner disclosed herein. Each group is loaded with data during a DMD load time 502 (ld) (as distinguished from the full load time). To ensure that the data is stable, a time period 503 is observed for data setup and a minimum time in which resets may occur (min_r_to_r). At any time after this time period 503, the data is considered stable and a reset signal may occur. The reset signal may be applied on the reset lines connected to the reset group any time within the reset valid region 504 (as disclosed herein), causing the SLM to change states in accordance with the data stored in its memory cell. After being reset, the reset group begins its display time. At the end of the reset signal, the pixels have a "hold" time 505 (hld) during which the data must be stable prior to the next load signal 502 (id). Valid regions 504 in which a reset can occur are each between the end of the data setup 503 and the beginning of the next data hold 505 (hld) periods.

By using any number of algorithms, creatable by those who are skilled in the pertinent field of art, placement of each reset command/signal may be made anywhere within the reset valid regions 504, so long as the employed algorithm accounts for the mim_r_to_r time so that enough time is available in the sequence for loads to occur. Thus, adjacent or consecutive short bit segments may be maintained in the sequence, while observing the bit-plane overall timing constraints. As a result, the disclosed technique, as described in the embodiments below, provides beneficial flexibility in reset signal placement within a bit sequence not attainable with conventional techniques.

One benefit to the disclosed technique is that by having the ability to vary the location in time and duration of the "ON" time (through the placement of the reset signals), visual artifacts can be reduced. A further benefit of the disclosed flexible reset placement is obtained for systems employing NDF techniques, in which contiguous short bit sequences are typically found. As a result, the use of the described technique provides improved PWM performance in SLM television products, as well as Digital Light Processing (DLP) Cinema systems.

Figure 6:
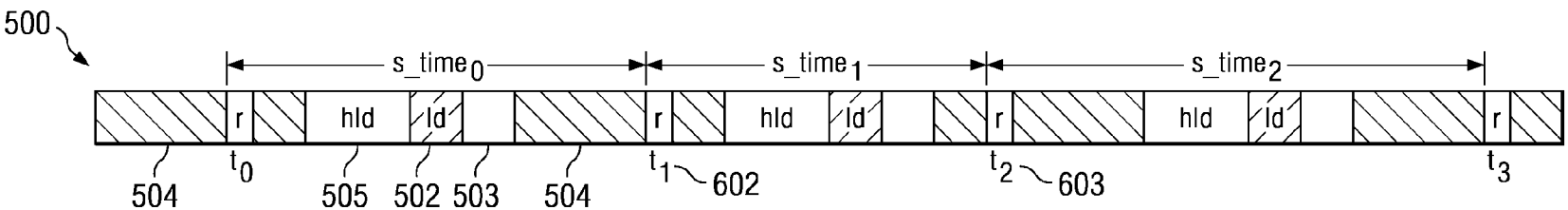
FIG. 6 illustrates a larger portion of the bit sequence shown in FIG. 5 having flexible reset placement and the associated s_time in bit-plane timing.

Referring now to FIG. 6, illustrated is a larger portion of the bit sequence 500 shown in FIG. 5. This larger portion shows an example of the disclosed technique where a time ($t_2-t_1$) between consecutive second and third reset signals 602, 603 is shortened such that this resulting bit segment is now a "short" segment adjacent to a first short segment defined by time $t_1-t_0$. As illustrated, the selectable placement of the reset defines the segment times ("s_times") for each of the bit segments in the sequence. As shown, $s_time_1$ in FIG. 6 illustrates the shortened bit-time between the second and third resets 602, 603 through the movement of the third reset 603 within its corresponding reset valid region. Thus, $s_time_1$ is now a short segment time and is adjacent to the first short segment $s_time_0$, while $s_time_2$ is now changed to a long segment. Equations (1)-(3) below show the relationship of the illustrated s_times to the reset signals in FIG. 6.

$$s_time_0=t_1-t_0 \tag{1}$$

$$s_time_1=t_2-t_1 \tag{2}$$

$$s_time_2=t_3-t_2 \tag{3}$$

As discussed above, the time between resets, the s_time, is the display time for the bit-plane. Time constraints, as shown in FIG. 5, establish the bounds for the minimum s_time, which can be as short as the sum of data setup time, group/DMD load-time, data hold time, and the minimum time from reset to reset (min_r_to_r). A minimum s_time ($s_time_{min}$) is established by the time constraints, which should be observed when moving resets as described herein so that ample load time remains in the sequence, and is shown in equation (4).

$$s_time_{min}=\max(\text{reset_sequence_time}, \text{min_}r\text{_to_}r)+hld+ld+datasetup \tag{4}$$

In accordance with equation (4), s_times can be independently adjusted by adjusting the placement of the resets in their respective valid regions, as well as by adjusting the time at which a data load (e.g., DMD load time) (Id) occurs. With this flexibility in placement, multiple adjacent "short" bit segments can be realized, so long as the $s_time_{min}$ is observed with regard to resulting segment lengths. In addition, the placement of the resets may be selected so as to alleviate potential reset conflicts existing in a plurality of such bit sequences. To this end, various algorithms can be generated to address the conflict resolutions, and potential reset conflicts should be considered when moving reset within the sequence as described herein.

Figure 7:
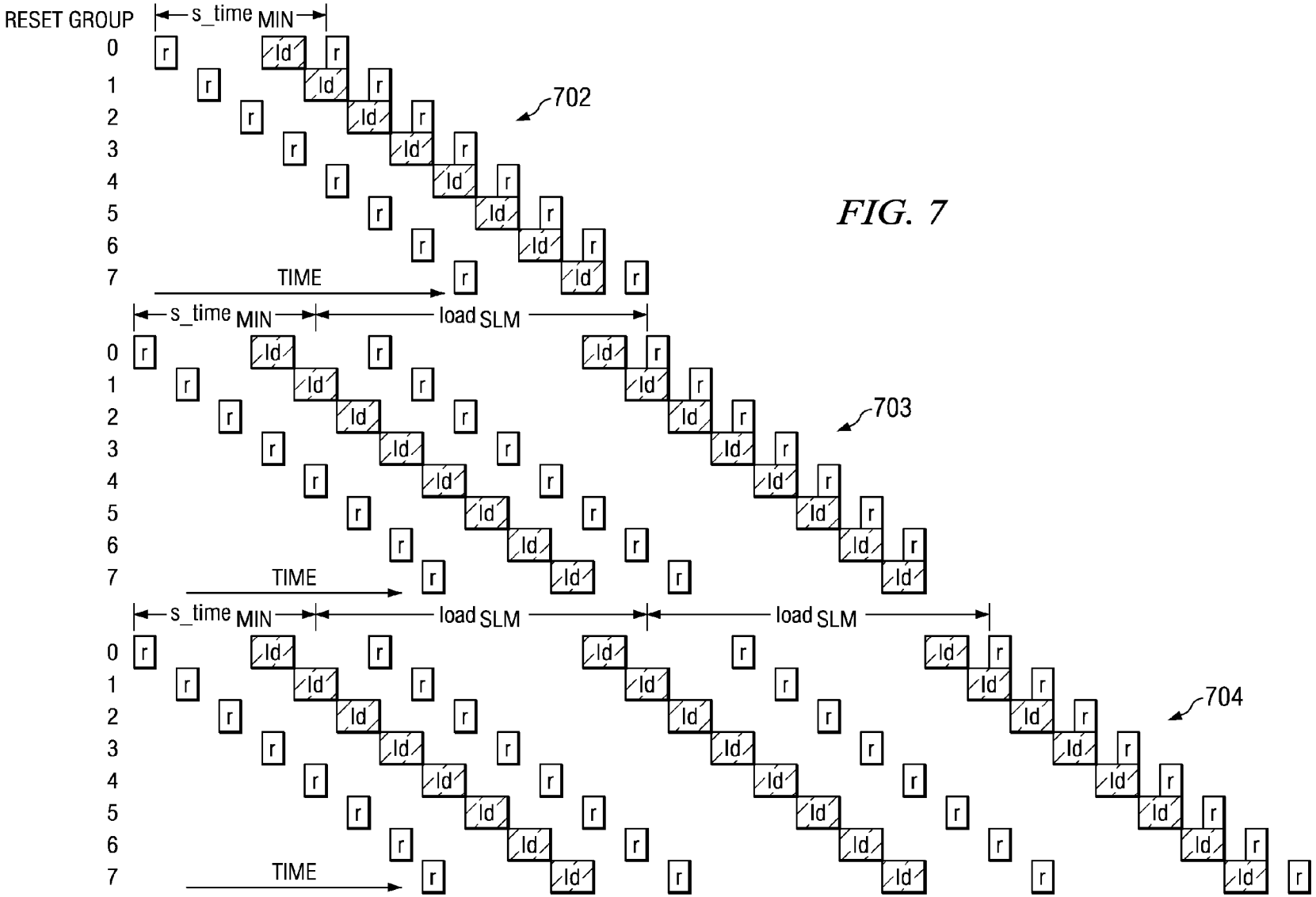
FIG. 7 illustrates an example of loading and resetting associated with 8 groups of pixels in which the resets are adjusted to provide for flexible reset sequences.

Turning to FIG. 7, illustrated are a plurality of bit-plane sequences 702, 703, 704. Specifically, bit-plane sequence 702 illustrates a sequence having $s_time_{min}$ as the time between consecutive reset signals. As discussed previously, a bit-plane for each group is loaded ($load_{group}$) on an SLM, followed by the next group of bit-planes, until a frame is complete. A full device load ($load_{SLM}$) is therefore employed between two consecutive s_times to allow for the image data to be presented to the SLM. This is illustrated in bit-plane sequence 703, where loading a pair of bit segments is shown to be greater than $s_time_{min}+load_{SLM}$. To further illustrate, three consecutive bit segments would be greater than $s_time_{min}+2*load_{SLM}$, which is illustrated in bit-plane sequence 704. Therefore, equation (5) sets forth the loading.

$$\Sigma s_times > s_time_{min}+(n-1)*load_{SLM} \tag{5}$$

Figure 8:
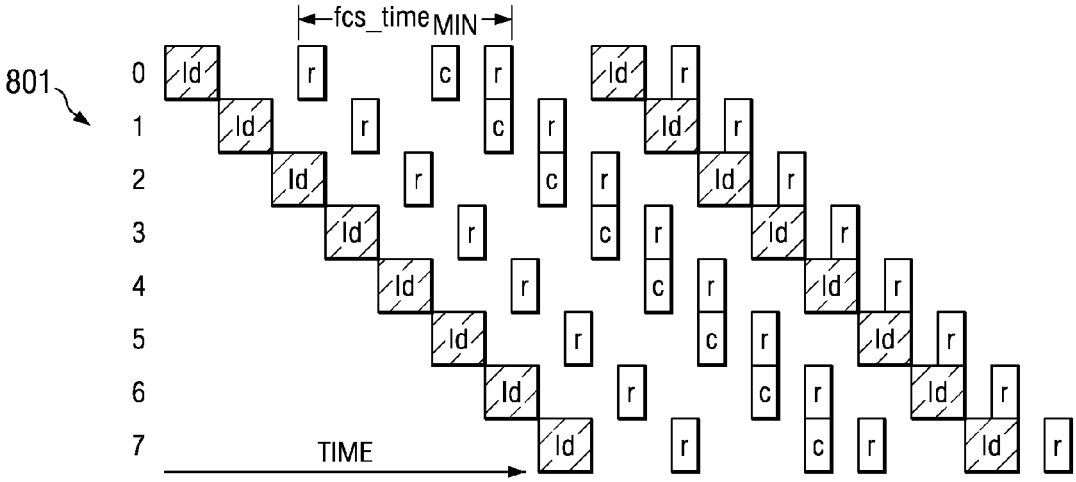
FIG. 8 illustrates an example of clearing and resetting associated with 8 groups of pixels in which the resets are adjusted to provide for flexible reset sequences.

In another embodiment, the same principles of the immediately preceding embodiment can be applied to a system utilizing a "fast clear" (fc) signal. The fast clear signal can be applied to a DMD device to clear the bit prior to the occurrence of a reset, thus bypassing the need to perform a load operation. FIG. 8 illustrates such a placement of a fast clear signal in a bit-plane sequence 801. As shown in bit-plane sequence 801, a fast clear signal (denoted as "c") replaces the load operation (ld) during the time span $fcs_time_{min}$, which in this embodiment represents the minimum time in which a fast clear is performed. Replacing the load operation (ld) from equation (4) with such a clear operation (clr) yields equation (6).

$$fcs_time_{min}=\max(reset_sequence_time, min_r_to_r)+hld+clr+datasetup \quad (6)$$

A single fast clear bit-plane is therefore typically greater than $fcs_time_{min}$. Fast clear signals typically have timing constraints in addition to the constraints discussed above, such as the required time between a fast clear and a load. Such additional constraints, which would be evident to a system designer skilled in this filed of art, would be taken into account when generating an algorithm to develop the desired bit sequence if, for example, multiple fast clears are desired in a group of bit-plane sequences. All the adjacent segments in each such sequence would then be adjusted to sum to an amount greater than a constraint amount. That constraint amount is the sum of contributing values due to each segment in the chain. The embodiment illustrated in FIG. 8 is such an example, showing that additional variations of the flexible reset scheme presented here can be implemented using various algorithms and system capabilities. In each variation, the designer would determine the constraints and account for them in the algorithms applied to determine reset locations. Furthermore, the use of the disclosed technique may also be employed in other types of reset sequences, without varying from the broad scope disclosed herein.

To this point, there has been disclosed a technique by which flexible resets can be applied to a system employing an SLM. However, this is not intended to limit the scope of the processes to only the described embodiments. Moreover, while various embodiments of reset conflict resolution techniques according to the principles disclosed herein have been described above, it should be understood that they have been presented by way of example only, and not limitation. Thus, the breadth and scope of the invention(s) should not be limited by any of the above-described exemplary embodiments, but should be defined only in accordance with any claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Technical Field," such claims should not be limited by the language chosen under this heading to describe the so-called technical field. Further, a description of a technology in the "Background" is not to be construed as an admission that technology is prior art to any invention(s) in this disclosure. Neither is the "Brief Summary" to be considered as a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings set forth herein.

What is claimed is:

1. A method for displaying an image on a display system employing a spatial light modulator having pixels addressable with orienting and reorienting data formatted in corresponding bit-planes, each of the bit-planes loaded as segments in a bit sequence during a frame-time, the method comprising:

providing a first load signal to the spatial light modulator, the first load signal having orienting data for at least one of the pixels;

providing a first reset signal to the spatial light modulator for orienting the at least one pixel in accordance with the orienting data;

providing a second load signal to the spatial light modulator, the second load signal having reorienting data for the at least one pixel;

providing a second reset signal to the spatial light modulator for reorienting the at least one pixel in accordance with the reorienting data, an amount of time between providing the first and second reset signals defining a length of time of a first segment of the at least one pixel;

providing a third load signal to the spatial light modulator, the third load signal having further reorienting data for the at least one pixel;

providing a third reset signal to the spatial light modulator for further reorienting the at least one pixel in accordance with the further reorienting data, an amount of time between providing the second and third reset signals defining a length of time of a second segment of the at least one pixel after the first segment; and adjusting times for providing the first, second, and third reset signals after their corresponding first, second, and third load signals such that the first and second segments are each less than or each greater than a full load-time for the spatial light modulator, and wherein one of the segments represents a neutral density filtering bit segment.

2. A method according to claim 1, further comprising providing a fast clear signal between providing the first, second, or third reset signals.

3. A method according to claim 1, wherein the amount of time between providing the first and second reset signals is greater than a reset-to-reset period that comprises a minimum period required for loading and stabilizing the data provided by a load signal.

4. A method according to claim 1, further comprising adjusting the amount of time between providing the first, second, and third reset signals so as to decrease the length of time of the first segment, while proportionally increasing a length of time of the second segment in the sequence.

5. A method according to claim 4, wherein the second segment in the sequence is adjacent the first segment.

6. A method according to claim 1, further comprising adjusting the amount of time between providing the first, second, and third reset signals so as to decrease the length of time of the first segment, while also decreasing a length of time of the second segment in the sequence.

7. A method according to claim 6, wherein the second segment in the sequence is adjacent the first segment.

8. A method according to claim 1, further comprising adjusting the amount of time between providing the first, second, and third reset signals so as to avoid a reset conflict with another sequence during the same display frame.

9. A system for displaying an image, the system comprising:

a spatial light modulator having pixels addressable with orienting and reorienting data formatted in corresponding bit-planes; and at least one bit-plane configured to provide the orienting and reorienting data, the at least one bit-plane loaded as segments in a bit sequence during a frame-time;

a first load signal in the at least one bit-plane to the spatial light modulator, the first load signal having orienting data for at least one of the pixels;

a first reset signal to the spatial light modulator for orienting the at least one pixel in accordance with the orienting data;

a second load signal to the spatial light modulator, the second load signal having reorienting data for the at least one pixel;

a second reset signal to the spatial light modulator for reorienting the at least one pixel in accordance with the reorienting data, an amount of time between the first and second reset signals defining a length of time of a first segment of the at least one pixel;

a third load signal to the spatial light modulator, the third load signal having further reorienting data for the at least one pixel;

a third reset signal to the spatial light modulator for further reorienting the at least one pixel in accordance with the further reorienting data, an amount of time between the second and third reset signals defining a length of time of a second segment of the at least one pixel after the first segment;

a sequence generator for providing the reset and load signals to the spatial light modulator, and for calculating a first length of time for the first segment and a second length of time for the second segment; and wherein the first, second, and third reset signals are operable in the at least one bit-plane to be adjusted with respect to their corresponding first, second, and third load signals such that the first segment has the first length of time and the second segment has the second length of time, and such that the first and second segments are each less than or each greater than a full load-time for the spatial light modulator.

10. A system according to claim 9, wherein one of the segments represents a neutral density filtering bit segment.

11. A system according to claim 9, further comprising a fast clear signal provided between the first, second, or third reset signals.

12. A system according to claim 9, wherein the amount of time between the first and second reset signals is greater than a reset-to-reset period that comprises a minimum period required for loading and stabilizing the data provided by the load signal.

13. A system according to claim 9, wherein the amount of time between the first, second, and third reset signals is adjustable so as to decrease the length of time of the first segment, while proportionally increasing a length of time of the second segment in the sequence.

14. A system according to claim 13, wherein the second segment in the sequence is adjacent the first segment.

15. A system according to claim 9, wherein the amount of time between the first, second, and third reset signals is adjustable so as to decrease the length of time of the first segment, while also decreasing the length of time of the second segment in the sequence.

16. A system according to claim 15, wherein the second segment in the sequence is adjacent the first segment.

17. A system according to claim 9, wherein the amount of time between providing the first, second, and third reset signals is adjustable so as to avoid a reset conflict with another sequence during the same display frame.

18. A method for displaying an image on a display system employing a spatial light modulator having pixels addressable with orienting and reorienting data formatted in corresponding bit-planes, each of the bit-planes loaded as segments in a bit sequence during a frame-time, the method comprising:

providing a first load signal to the spatial light modulator, the first load signal having orienting data for at least one of the pixels;

providing a first reset signal to the spatial light modulator for orienting the at least one pixel in accordance with the orienting data;

providing a second load signal to the spatial light modulator, the second load signal having reorienting data for the at least one pixel;

providing a second reset signal to the spatial light modulator for reorienting the at least one pixel in accordance with the reorienting data, an amount of time between providing the first and second reset signals defining a length of time of a first segment of the at least one pixel;

providing a third load signal to the spatial light modulator, the third load signal having further reorienting data for the at least one pixel;

providing a third reset signal to the spatial light modulator for further reorienting the at least one pixel in accordance with the further reorienting data, an amount of time between providing the second and third reset signals defining a length of time of a second segment of the at least one pixel after the first segment; and adjusting times for providing the first, second, and third reset signals after their corresponding first, second, and third load signals such that the first and second segments are each less than or each greater than a full load-time for the spatial light modulator, and so as to decrease the length of time of the first segment while proportionally increasing a length of time of the second segment in the sequence.

19. A method for displaying an image on a display system employing a spatial light modulator having pixels addressable with orienting and reorienting data formatted in corresponding bit-planes, each of the bit-planes loaded as segments in a bit sequence during a frame-time, the method comprising:

providing a first load signal to the spatial light modulator, the first load signal having orienting data for at least one of the pixels;

providing a first reset signal to the spatial light modulator for orienting the at least one pixel in accordance with the orienting data;

providing a second load signal to the spatial light modulator, the second load signal having reorienting data for the at least one pixel;

providing a second reset signal to the spatial light modulator for reorienting the at least one pixel in accordance with the reorienting data, an amount of time between providing the first and second reset signals defining a length of time of a first segment of the at least one pixel;

providing a third load signal to the spatial light modulator, the third load signal having further reorienting data for the at least one pixel;

providing a third reset signal to the spatial light modulator for further reorienting the at least one pixel in accordance with the further reorienting data, an amount of time between providing the second and third reset signals defining a length of time of a second segment of the at least one pixel after the first segment; and adjusting times for providing the first, second, and third reset signals after their corresponding first, second, and third load signals such that the first and second segments are each less than or each greater than a full load-time for the spatial light modulator, and so as to decrease the length of time of the first segment, while also decreasing a length of time of the second segment in the sequence.

20. A method according to claim 19, wherein the second segment in the sequence is adjacent the first segment.

* * * * *